313-422 SR
11/5/85 XR 4,551,648

United States Patent [19]
Gange

[11] Patent Number: 4,551,648
[45] Date of Patent: Nov. 5, 1985

[54] LINE CATHODE HEATER AND SUPPORT STRUCTURE FOR A FLAT PANEL DISPLAY DEVICE

[75] Inventor: Robert A. Gange, Belle Mead, N.J.

[73] Assignee: RCA Corporation, Princeton, N.J.

[21] Appl. No.: 537,816

[22] Filed: Sep. 30, 1983

[51] Int. Cl.[4] ..... H01J 1/88

[52] U.S. Cl. ..... 313/37; 313/411; 313/417; 313/422; 313/456; 313/270; 313/302; 313/337

[58] Field of Search ..... 313/422, 411, 417, 456, 313/409, 446, 302, 337, 270, 341, 37

[56] References Cited

U.S. PATENT DOCUMENTS 4,119,882 10/1978 Chin ..... 313/270
4,121,130 10/1978 Gange ..... 313/409
4,217,519 8/1980 Catanese et al. ..... 313/411
4,429,251 1/1984 Gange ..... 313/411

*Primary Examiner*—William F. Smith
*Attorney, Agent, or Firm*—E. M. Whitacre; D. H. Irlbeck; L. L. Hallacher

[57] ABSTRACT

A heater and support structure for a line cathode includes heater electrodes and an S-shaped cathode support member arranged between the heater electrodes. The heater electrodes and the S-shaped support member have a higher resistance than the cathode and thus heat flows into the cathode to compensate for heat radiation losses and the support compensates for thermal expansion to retain the cathode at a substantially constant position.

3 Claims, 3 Drawing Figures

LINE CATHODE HEATER AND SUPPORT STRUCTURE FOR A FLAT PANEL DISPLAY DEVICE

BACKGROUND OF THE INVENTION

This invention relates generally to flat panel display devices and particularly to a line cathode heater and support structure for such devices.

U.S. Pat. No. 4,217,519 discloses a modulator structure for a flat panel display device. An insulative modulator support has a plurality of modulation electrodes disposed on one side. The support structure is affixed to an insulative baseplate which also supports a plurality of modulation electrodes. The modulation electrodes are electrically connected in pairs whereby one electrode for each pair is supported by the modulator support and the other by the baseplate. A line cathode is arranged across the entire transverse, or horizontal, dimension of the display device between the modulation electrode pairs. The display device is divided into channels and each includes a beam guide assembly having two spaced guide meshes between which electrons propagate as beams. The entrance to each of the beam guide assemblies is arranged between the modulation electrode pairs so that electrons from the cathode are injected into the spaces between the guides meshes.

U.S. patent application Ser. No. 355,253, filed Mar. 5, 1982 by R. A. Gange and entitled "LINE CATHODE SUPPORT STRUCTURE FOR A FLAT PANEL DISPLAY DEVICE" now U.S. Pat. No. 4,429,251 discloses a line cathode support which can be utilized with the modulator structure disclosed in the above-referenced patent. A U-shaped member supports the line cathode equidistant from and in alignment with the spaces between the guide meshes for every channel. The U-shaped member is transversely dimensioned to span the space between the guide meshes and is spring biased against the meshes. The U-shaped member has high thermal impedance and is electrically insulated. A notch is arranged in closed end to support the cathode in alignment with the spaces between the guide meshes and the member is longitudinally dimensioned to support the cathode a predetermined distance from the spaces.

SUMMARY OF THE INVENTION

A heater and support structure for a line cathode includes a pair of spaced heater electrodes having a resistance higher than the resistance of the cathode. A cathode support member supports the cathode between the heater electrodes. The support member is configured as a substantially S-shaped member having a cathode retention portion in the proximity of the center and coupling portions in the proximity of the open ends for coupling the support member to the heater electrodes. DR

DETAILED DESCRIPTION OF THE PREFERRED EMBODIMENT

Figure 1:
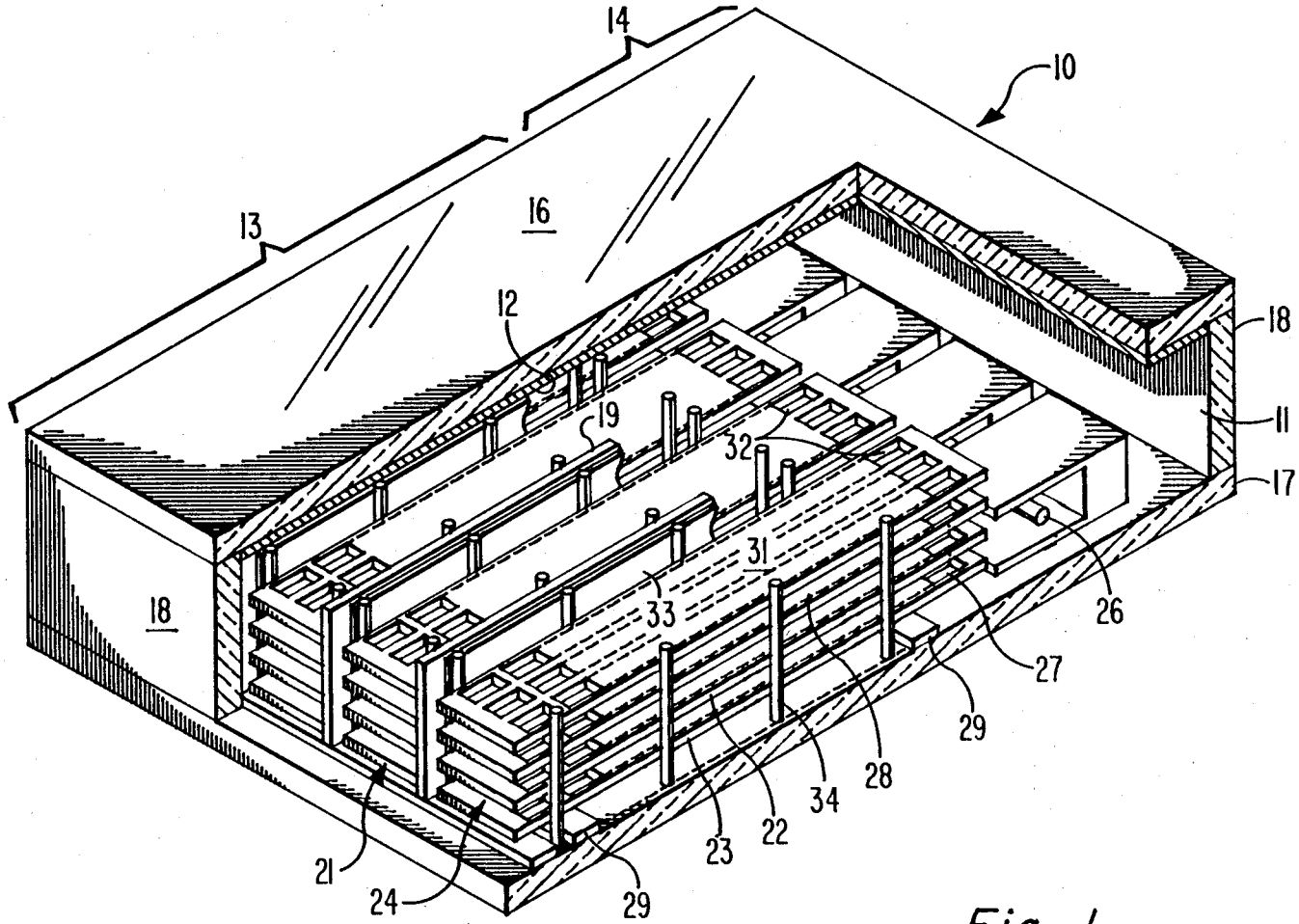
FIG. 1 is a perspective view, partially broken away, of a flat panel display device in which the preferred embodiment can be incorporated.

FIG. 1 shows a flat panel display device 10 in which the preferred embodiment can be incorporated. The display device 10 includes an evacuated envelope 11 having a display section 13 and an electron gun section 14. The envelope 11 includes a frontwall 16 and a baseplate 17 held in a spaced parallel relationship by sidewalls 18. A display screen 12 is positioned along the frontwall 16 and gives a visual output when struck by electrons.

A plurality of spaced parallel support vanes 19 are arranged between the frontwall 16 and the baseplate 17. The support vanes 19 provide the desired internal support against external atmospheric pressure and divide the envelope 11 into a plurality of channels 21. Each of the channels 21 encloses a pair of spaced parallel beam guide meshes 22 and 23 extending transversely, or horizontally, across the channels and longitudinally, or vertically, along the channels from the gun section 14 to the opposite sidewall 18. A cathode 26 is arranged to emit electrons into the spaces 24 between the guide mesh pairs. The guide meshes 22 and 23 include apertures 27 which are arranged in columns longitudinally along the channels 21 and in rows transversely across the channels. A focus mesh 28 is spaced above the upper guide mesh 22 in a parallel relationship therewith. A plurality of extraction electrodes 29 are arranged along the baseplate 17 to extend transversely across the channels 21 the full width of the display device 10. The extraction electrodes 29 are arranged directly beneath the rows of apertures 27 in the guide meshes 22 and 23. Appropriate biasing voltages are applied to the focus mesh 28 and the extraction electrodes 29 to cause the electrons emitted from the cathode 26 to be periodically focused between the guide meshes 22 and 23 and to propagate in the spaces 24 for the full length of the channels.

An acceleration mesh 31 is arranged in a spaced parallel relation with the focus mesh 28 and contains a plurality of apertures 32 which also are aligned in columns longitudinally of the channels and in rows transversely of the channels. Scanning electrodes 33 are arranged on both sides of the support vanes 19 so that each vane supports a scanning electrode for two adjacent channels. Insulative beads 34 engage the meshes 22, 23, 28 and 31 to retain the meshes in the desired space relationship.

In operation, the electron beams propagate in the spaces between the guide meshes 22 and 23 until they are extracted by a change in voltage on one of the electrodes 29 to produce one horizontal line of the visual display. The beams are directed toward the screen 12 by acceleration mesh 31. Extraction of the electron beams from the spaces between the guide meshes is effected by applying a negative voltage to one of the extraction electrodes 29. The negative voltage causes the electron beams to pass through the apertures 27 in the guide meshes and the apertures 32 in the focus mesh 28 and the acceleration mesh 31. The extracted electron beams are horizontally scanned across the channels 21 by the application of varying voltages, such as sawtooth waveforms, to the scanning electrodes 33 on the sides of the support vanes 19. Every channel therefore is horizontally scanned between the two support vanes 19 so that each channel contributes a portion of each horizontal line of the visual display on the faceplate 16. A line cathode supplies the electrons for every channel and each channel contributes to every horizontal line of the display. For these reasons, it is critical that the cathode be supported the same distance from the entrances to the spaces 24 between the beam guide meshes and that the cathode is aligned with such entrances. Also, because a line cathode is used, it is important for the temperature profile across the cathode to be as uniform as possible for the three colors. Thus, it is important to compensate for heat radiation and conduction losses to maintain a uniform temperature profile across the full length of the cathode.

Figure 2:
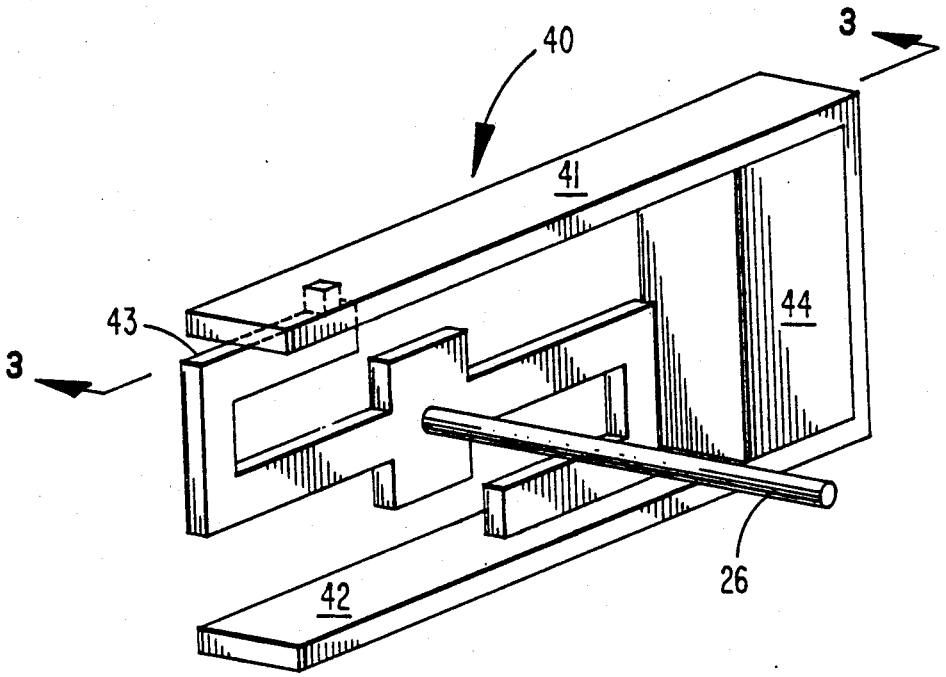
FIG. 2 is a perspective view of a preferred embodiment.

FIG. 2 shown a heater and support structure 40 for the line cathode 26 of FIG. 1. The support structure 40 includes two heater electrodes 41 and 42 arranged in a spaced relationship so that the cathode 26 can be arranged between the electrodes. An S-shaped support member 43 supports the cathode 26 between the heater electrodes 41 and 42. A support 42 between the heater electrodes 41 and 42 gives physical support to the electrodes and is preferably of the same material.

Figure 3:
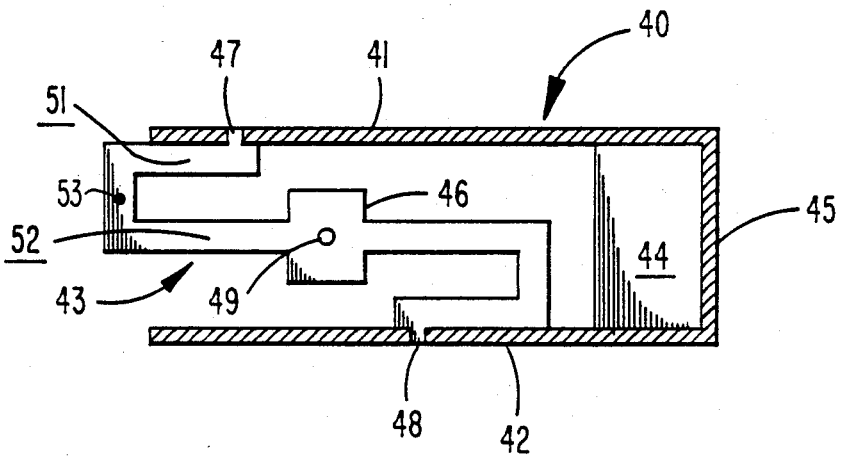
FIG. 3 is a cross section of the preferred embodiment of FIG. 2.

In FIG. 3, the heater electrodes 41 and 42 are shown connected by a conductor 45. Thus, the heater electrodes 41 and 42 are formed as a bifilar element. The support 44 is fritted to otherwise permanently affixed, to the inside of the closed end of the bifilar element. The cathode support member 43 includes a cathode retention portion 46 in the proximity of the center of the S-shaped member. Coupling portions 47 and 48, in the form of tabs, are provided in the proximity of the open ends of the cathode support member 43. The coupling portions 47 and 48 engage apertures which are etched, or otherwise provided, in the heater electrodes 41 and 42 to accurately locate the support member 43 with respect to the entrances to the spaces 24 between the guide meshes 22 and 23 (FIG. 1). An aperture 49 is provided in the center of the cathode retention portion 46 to receive the cathode 26 and accurately locate the cathode with respect to the guide meshes 22 and 23.

In operation, a voltage is applied to the cathode 26 (FIG. 2) through the heater electrodes 41 and 42 and the cathode support member 43. The line cathode 26 is typically made of a 12 mil diameter tungsten wire which is heated by the passage of current through the wire. The wire is coated with emissive material in the appropriate locations so that electrons emanate from the emissive material and are attracted into the beam guide meshes for propagation along the meshes. Because electron emission from the emissive material depends upon the temperature of the tungsten heater, it is preferable that the temperature profile along the cathode length be as uniform as possible. Uniformity of temperature profile along the cathode length can be achieved by utilizing the heater electrodes 41 and 42 and the cathode support member 43 to provide heat into the cathode 26 and thereby compensate for heat radiation losses along the cathode length. Thus, for the multi-module flat panel display device illustrated in FIG. 1, a plurality of the heater and support structures 40 (FIG. 3) in accordance with the invention are arranged periodically along the horizontal dimension of the display device. In order for the heater electrodes 41 and 42 and the support member 43 to compensate for heat loss from the cathode it is necessary for these elements to obtain a temperature equal to that of the cathode at the points of contact. Accordingly, the heater electrodes 41 and 42 and the cathode support member 43 are made from materials configured to have higher resistance that the tungsten from which the cathode 26 is fabricated. The cathode support member preferably exhibits spring loading against the heater electrodes 41 and 42 even when heated to the compensating temperature. A number of metals have been found to satisfy these requirements. For example, the cathode support member 43 can be made from molybdenum. The heater electrodes 41 and 42 are not critical and can be made from a large number of commercially available materials such as nickle plated copper or nickle plated steel. An important feature of the invention is that as the cathode support member 43 expands because of increasing temperature, the design is such that equal amounts of movement occurs in sections 51 and 52 (FIG. 3). Thus by symmetry, the cathode location remains stable during cathode warmup. The cold and hot cathode location is therefore the same.

The temperature along sections 51 and 52 is nonlinear, because of radiation from the region of section 52 near the cathode. In the case of a circular cross-section of diameter "d" of the cathode 26, the temperature is described by:

$$\frac{d^2t}{dx^2} + \frac{1}{k}\left(\frac{dk}{dt}\right)\left(\frac{dt}{dx}\right)^2 + \left\{\frac{16I^2\rho}{\pi^2kd^4} - \frac{4\sigma\epsilon t^4}{kd}\right\} \quad (1)$$

where:

I=current thru section 51 and 52
t=temperature
x=distance
k=thermal conductivity
d=diameter
$\rho$=resistivity
$\sigma$=Stephan's constant
$\epsilon$=emissivity Equation (1) also describes the temperature of the support structure 43 when a circular cross-section is used. One skilled in the art, can adapt the Equation to accommodate other cross-sections by substituting the cross-section dimensions for the diameter. The amount of expansion $\Delta L$ in sections 51 and 52 is given in terms of the temperature dependent expansion coefficient $\alpha(t)$ of the material employed. Since the temperature changes as a function of position along the sections, the infinitesimal change at point x is:

$$dL = L(t)\alpha(t)dt$$

By identifying sections 51 and 52 as parts 1 and 2, respectively, and by defining the temperature at point 53 (FIG. 3) as $T_{12}$, the design criterion can be expressed in terms of the distances $x(t), x_2(t)$ and temperatures $T_0$, $T_2$ at the heater electrode and cathode, respectively as:

$$\int_{T_0}^{T_{12}} X_1(t)\alpha(t)dt = \int_{T_{12}}^{T_2} X_2(t)\alpha(t)dt \quad (3)$$

The relationship between distance and temperature $X(t), X_2(t)$ is found from equation (1). The expansion coefficient $\alpha(t)$ depends upon the materials chosen. By way of example, if molybdenum of 2 mil×8 mil rectangular cross-section is chosen, and if $T_0$ and $T_2$ are taken to be 300° k. and 1055° k., then the lengths of sections 51 and 52 at room temperature are 133 mils and 80 mils respectively, and $T_{12}$ is 851° k. Under these conditions the two sections 42 and 50 will expand equal amounts (0.42 mils) during cathode warmup.

What is claimed is:

1. A heater and support structure for a line cathode comprising:

a pair of spaced heater electrodes, said heater electrodes having a resistance higher than the resistance of said cathode whereby current passing through said heater electrodes and said cathode causes heat generated in said heater electrodes to compensate for heat loss from said cathode;

a cathode support member for supporting said cathode between said heater electrodes, said support member being configured as a substantially S-shaped member to compensate for thermal expansion whereby the positioning of said cathode remains substantially constant during temperature changes, said support member having a cathode retention portion in the proximity of the center and having coupling portions in the proximity of the open ends for coupling said support member to said heater electrodes.

2. The heater and support structure of claim 1 whereby said heater electrodes are in the form of a bifilar element.

3. The heater and support structure of claim 2 further including a support affixed to the inside of the closed end of said bifilar element.

* * * * *

UNITED STATES PATENT AND TRADEMARK OFFICE
CERTIFICATE OF CORRECTION

PATENT NO. : 4,551,648

DATED : November 5, 1985

INVENTOR(S) : Robert A. Gange

It is certified that error appears in the above-identified patent and that said Letters Patent is hereby corrected as shown below:

Col. 1, line 59, delete "DR".

Col. 2, line 51, after "spaces" insert -- 24 --.

Col. 3, line 19, delete "42" second occurence and insert -- 44 --.

Signed and Sealed this

Twenty-first Day of October, 1986

[SEAL]

*Attest:*

DONALD J. QUIGG

*Attesting Officer*

*Commissioner of Patents and Trademarks*